US006763897B2

(12) United States Patent
Hanke et al.

(10) Patent No.: US 6,763,897 B2
(45) Date of Patent: Jul. 20, 2004

(54) HAMMER

(75) Inventors: Andreas Hanke, Bad Camberg (DE); Reinhard Plietsch, Brechen (DE); Stefan D. Gensmann, Früchtl (DE); Heinz-Werner Faatz, Schmitten (DE); Reimund Becht, Hühnfelden (DE)

(73) Assignee: Black & Decker Inc., Newark, DE (US)

( * ) Notice: Subject to any disclaimer, the term of this patent is extended or adjusted under 35 U.S.C. 154(b) by 37 days.

(21) Appl. No.: 10/126,567

(22) Filed: Apr. 19, 2002

(65) Prior Publication Data

US 2002/0185288 A1 Dec. 12, 2002

(30) Foreign Application Priority Data

Apr. 20, 2001 (GB) ..... 0109747

(51) Int. Cl.[7] ..... B25D 11/04

(52) U.S. Cl. ..... 173/210; 173/90; 173/201; 173/211; 173/162.2

(58) Field of Search ..... 227/1; 173/90, 173/210–211, 201, 162.2

(56) References Cited

U.S. PATENT DOCUMENTS

| | | | | |
|---|---|---|---|---|
| 2,608,118 A | | 8/1952 | Disser | |
| 2,632,331 A | | 3/1953 | Pinazza | |
| 2,875,731 A | * | 3/1959 | Settles et al. | 267/137 |
| 2,899,934 A | | 8/1959 | Salengro | |
| 3,010,730 A | | 11/1961 | Fuehrer | |
| 3,509,948 A | | 5/1970 | Besnard | |
| 4,478,293 A | | 10/1984 | Weilenmann et al. | |
| 4,668,134 A | | 5/1987 | Vindez | |
| 4,681,172 A | | 7/1987 | Mikiya et al. | |
| 4,776,408 A | | 10/1988 | Elkin et al. | |
| 5,199,831 A | | 4/1993 | Broucksou | |
| 5,281,056 A | | 1/1994 | Lawson et al. | |
| 5,573,075 A | | 11/1996 | Henry et al. | |
| 5,626,199 A | | 5/1997 | Henry et al. | |
| 5,850,884 A | | 12/1998 | Rodger et al. | |
| 5,971,083 A | | 10/1999 | Wiklund | |
| 5,975,217 A | | 11/1999 | Frenzel et al. | |
| 6,123,243 A | | 9/2000 | Pfister et al. | |
| 6,152,245 A | | 11/2000 | Nilsson | |
| 6,192,997 B1 | | 2/2001 | Tsai et al. | |
| 6,237,699 B1 | * | 5/2001 | Plietsch et al. | 173/201 |
| 6,325,157 B1 | * | 12/2001 | Arakawa et al. | 173/201 |

FOREIGN PATENT DOCUMENTS

| | | |
|---|---|---|
| DE | 815179 | 10/1951 |
| DE | 2403074 | 4/1975 |
| DE | 2653046 | 5/1978 |
| DE | 3127791 | 5/1982 |
| DE | 3122979 | 1/1983 |
| DE | 223390 | 6/1985 |
| DE | 3632418 | 3/1988 |
| DE | 29505125 | 6/1995 |
| EP | 0564217 | 10/1993 |
| GB | 2053768 | 2/1981 |
| GB | 2129733 | 5/1984 |
| SU | 933446 | 6/1982 |

* cited by examiner

*Primary Examiner*—Rinaldi I. Rada
*Assistant Examiner*—Michelle Lopez
(74) *Attorney, Agent, or Firm*—Michael P. Leary; Bruce S. Shapiro; Charles E. Yocum

(57) ABSTRACT

A hand held electrically powered hammer comprises a housing, a motor, and a hollow spindle. A piston and a ram are located for reciprocation within the spindle. A casing encloses at least part of the spindle so as to define a chamber between the spindle and the casing. A damping mass is slideably supported by a spacer and is located within the chamber and is connected to the hammer housing via a spring so as to oscillate back and forth along the spindle to minimize the vibration of the hammer housing and also so as to generate air flows within the chamber for facilitating heat transfer from the spindle to the metal casing.

19 Claims, 7 Drawing Sheets

HAMMER

BACKGROUND OF THE INVENTION

This invention relates to hand held electrically powered hammers, and in particular to demolition hammers.

Such hammers generally comprise a housing within which is located an electric motor and a gear arrangement for converting the rotary drive of the motor to a reciprocating drive to drive a piston within a hollow spindle, which spindle is located within the hammer housing. The spindle may be formed from a single part or from more than one part, for example from a rearward hollow cylinder, within which a piston and ram reciprocate and a forward cylindrical tool holder body, within which a tool or bit may be releasably mounted. A ram is located in front of the piston within the spindle so as, in normal operating conditions, to form a closed air cushion within the spindle between the piston and the ram. The reciprocation of the piston reciprocatingly drives the ram via the air cushion. A beatpiece is generally located within the spindle and transmits repeated impacts that it receives from the ram to a tool or bit releaseably mounted for limited reciprocation in front of the beatpiece in a tool holder portion of the spindle. The impacts on the tool or bit are transmitted to a workpiece against which the tool or bit is pressed in order to break up or make a bore in the workpiece.

Some hammers may also be employed in combination impact and drilling mode in which the spindle, and hence the bit inserted therein, will be caused to rotate at the same time as the bit is struck by the beatpiece. The present invention is also applicable to such rotary hammers.

One problem with such hammers is that the reciprocating parts and repeated impacts between the parts cause large vibrations to be transmitted via the handles of the hammer to the user. This is uncomfortable for the user, particularly over prolonged periods of use and can contravene safety standards.

This problem has been solved in the past by forming a vibration damping linkage between the handles of the hammer and the main housing of the hammer. However, the linkages have to be rigid enough for the handles to guide the hammer while also providing damping. Also, the user of the hammer tensions the linkage when the hammer is urged against a workpiece and this changes the damping effect of the linkage. This means that such linkages tend to be relatively complex.

This problem has also been solved for a pneumatic hammer, for example as disclosed in DE815,179 by mounting masses on opposing sides of the spindle, with each mass mounted between two springs so that each of the masses can oscillate parallel to the axis of the spindle due to the forces from the two springs. The masses oscillate in phase and in the same direction as the ram and are arranged to oscillate as near to resonance as possible. However, this gives rise to the problem of synchronising movement of the masses. If the masses are not exactly synchronised then a torque at right angles to the direction of mass vibration is generated which is transmitted to the user of the hammer via the hammer housing. This problem has been addressed in DE31 22 979 which describes an electrically powered hammer to which a dampening housing is attached. The dampening housing comprises two moveable masses each connected to a compression spring. The channels in which the masses are located are interconnected so that generation of an over pressure in one channel results in a corresponding over pressure in the other channel in order to synchronise movement of the masses. However, the arrangement disclosed in DE31 22 979 is relatively complex and takes up a lot of space.

The problem of synchronising masses can also be overcome for a pneumatic hammer by using a single mass as described in DE24 03 074 in which there is described a hammer housing which is enclosed by a handle housing. Around the hammer housing is located a cylindrical mass which is able to reciprocate along the hammer housing on the end of a coil spring. Optimum vibration reduction is achieved if the spring constant of the coil spring is adapted to the beat frequency of the hammer.

A second problem is that the reciprocating parts and repeated impacts cause heat generation within the hammer and some means is required to transfer the generated heat away from the spindle and the parts within the spindle. If the parts within the spindle are operating at high temperatures then they are more prone to wear and eventually to failure. In particular any seals between the piston and the spindle and the ram and the spindle are susceptible to damage at higher temperatures. Hammers are generally operated in very dusty environments and it is critical to the prolonged operation of the hammer that there is no dust ingress into the spindle. As there are several ports in the spindle through which air can flow into and out of the spindle, cooling of the spindle using air flows can easily introduce dust into the spindle.

Therefore, cooling of the spindle is generally achieved by passive heat transfer from the metal spindle either via air pockets or directly to metal housing parts surrounding the spindle. However, the cooling achieved by such passive heat transfer is relatively limited.

SUMMARY OF THE INVENTION

The present invention aims to overcome the problems discussed above by providing a system which both reduces the vibration of the hammer housing and cools the spindle, without taking up much space within the hammer housing.

According to the present invention there is provided a hand held electrically powered hammer, comprising a housing within which is located:

- a motor;
- hollow spindle within which is located for reciprocation therein a piston and forwardly of the piston a ram;
- a hammer drive arrangement which converts the rotary drive of the motor to a reciprocating drive to the piston;
- a tool holder body located at the forward end of the spindle in which a tool or bit may be releasably mounted for limited reciprocation;
- wherein the reciprocation of the piston reciprocatingly drives the ram via a closed air cushion such that repeated impacts from the ram are transmitted to a tool or bit mounted in the tool holder body, wherein the hammer additionally comprises:
  - a metal casing which encloses at least part of the spindle so as to form an air filled chamber between the spindle and the casing;
  - a damping mass, which is located within the chamber, which damping mass is connected to the hammer housing via at least one spring element so as to oscillate back and forth along the spindle to minimise the vibration of the hammer housing; and
  - at least one spacer element for positioning the damping mass with respect to the spindle and the metal casing so that a small gap is present between the mass and the spindle and a small gap is present between the mass and the casing such that oscillation of the damping mass within the chamber generates air turbulence within the chamber for facilitating heat transfer from the spindle to the metal casing.

The use of a damping mass oscillating within a chamber surrounding the spindle for reducing the vibration of the hammer housing is also used according to the present invention for generating air turbulence between the spindle and a metal casing part surrounding the spindle. When the damping mass moves forwardly along the spindle an overpressure is generated in front of the mass which causes air to flow rearwardly through the gaps between the mass and the spindle and the mass and the metal housing. When the damping mass moves rearwardly along the spindle an overpressure is generated rearwardly of the mass which causes air to flow forwardly through the gaps between the mass and the spindle and the mass and the metal housing. This air turbulence between the spindle and the metal casing can facilitate a three times increase in heat transfer away from the spindle as compared to passive heat transfer via an air pocket in which no turbulence occurs. According to the present invention the same components are used for the dual purpose of reducing the vibration transmitted to a user of the tool from the hammer housing and for cooling the spindle to improve the operation and lifetime of the hammer.

The hammer according to the present invention may comprise a beatpiece located for reciprocation within the spindle between the ram and a tool or bit mounted within the tool holder body for transferring impacts from the ram to a tool or bit mounted within the tool holder body. The incorporation of a beatpiece improves the sealing of the interior of the spindle from the tool holder body through which dust may enter.

For reducing any compensating vibrations due to the oscillation of the damping mass in a direction which is not parallel to the spindle, the metal casing and the the damping mass preferably encircle the spindle and the damping mass is preferably mounted so that it is concentric with the spindle. For a simple calibration of the mass and the spring or springs to compensate for vibrations in other parts of the hammer it is preferred that the damping mass comprises a single piece cylinder. Preferably, the mass is connected to the hammer housing via two springs one located forwardly of the mass between the mass and a forward housing part and the other located rearwardly of the mass between the mass and a rearward housing part. It is further preferred for a simple design in which the oscillating motion of the mass is easily controlled that the spring or each spring is a coil spring which encircles the spindle. Preferably, the mass is made of a relatively high density material such as steel or brass so that the mass does not take up too much space. For optimised vibration reduction in the hammer housing, the mass and the spring or springs are preferably arranged so that the mass oscillates back and forth along the spindle out of phase, preferably approximately 180° out of phase, with the beat frequency of the other hammer parts.

The air turbulence in the chamber preferably includes air flows between the mass and the spindle and air flows between the mass and the metal casing.

The or each spacer element may be formed integrally with the damping mass. Alternatively, the or each spacer element may comprise a guide arrangement which is slideably mounted on the spindle. The damping mass may be mounted on such a guide arrangement and the guide arrangement may be shaped to form at least one channel between the damping mass and the spindle through which air can flow. Preferably, the at least one channel is formed between a radially inward facing part of the guide arrangement and the outer surface of the spindle. This increases the amount of air flow over the surface of the cylinder to aid cooling. However, the location of the channels between a radially inward facing part of the guide arrangement and the outer surface of the spindle will also reduce the surface area of contact between the guide arrangement and the spindle and so can reduce the friction generated between the guide arrangement and the spindle as the guide arrangement slides back and forth along the spindle, which again facilitates improved cooling of the spindle. In an especially preferred embodiment in which the damping mass and the magnesium casing encircle the spindle, the or each guide arrangement is a guide ring, and preferably two such guide rings are used, one located at either end (forward and rearward end) of the damping mass. Where the guide arrangement is one or more guide rings, the channels may be formed between ribs formed on the radially inward facing surface of the guide ring. The use of such ribs also reduces the surface area of engagement between the guide ring and the spindle which will reduce the friction generated as the guide ring slides along the spindle.

The hammer according to the present invention may additionally comprise a fan arrangement for generating an airflow and a labyrinth formed by parts of the hammer housing for directing the airflow over the outer surface of the metal casing. Having an airflow over the metal casing, which airflow may be a flow of dusty air from the environment of the hammer, facilitates heat transfer from the metal casing. By cooling the metal casing in this way the cooling of the spindle via the turbulent air in the chamber is further improved. The fan may be rotatingly driven by the motor to avoid a need for extra means on the hammer for powering the fan. Preferably, the fan generates an airflow which passes over the motor, through the fan and then through the labyrinth and over the metal casing before being exhausted from the hammer housing. Thus, the fan can perform the dual function of cooling the motor and cooling the metal casing to facilitate cooling of the spindle. The fan is preferably a radial fan.

The present invention is particularly suited for use in a heavy duty demolition hammer wherein the hammer drive arrangement comprises a crank arm arrangement. The more powerful hammers have a higher requirement for cooling of the spindle.

The hammer housing may comprise an inner metal housing arrangement in which the motor, hammer drive arrangement and at least part of the spindle are mounted and an outer plastic housing rigidly fixed to the inner metal housing which outer housing comprises a handle. In this case the metal casing surrounding the spindle may be rigidly fixed to a forward portion of the inner metal housing arrangement. Then the damping mass may connected to the hammer via a first forward spring which extends between the mass and a part of the metal casing and via a second rearward spring which extends between the mass and a part of the metal housing arrangement.

Preferably the air filled chamber between the spindle and the casing communicates with at least one other air space formed within the hammer, for example with the interior of the inner metal housing arrangement and/or with a space between the ram and the beatpiece. This is important if the chamber surrounds the vent holes in the spindle through which air must pass to vent the air cushion between the piston and the ram on entry into idle mode.

BRIEF DESCRIPTION OF DRAWINGS

One form of rotary hammer according to the present invention will now be described by way of example with reference to the accompanying drawings in which.

DETAILED DESCRIPTION OF THE INVENTION

Figure 1:
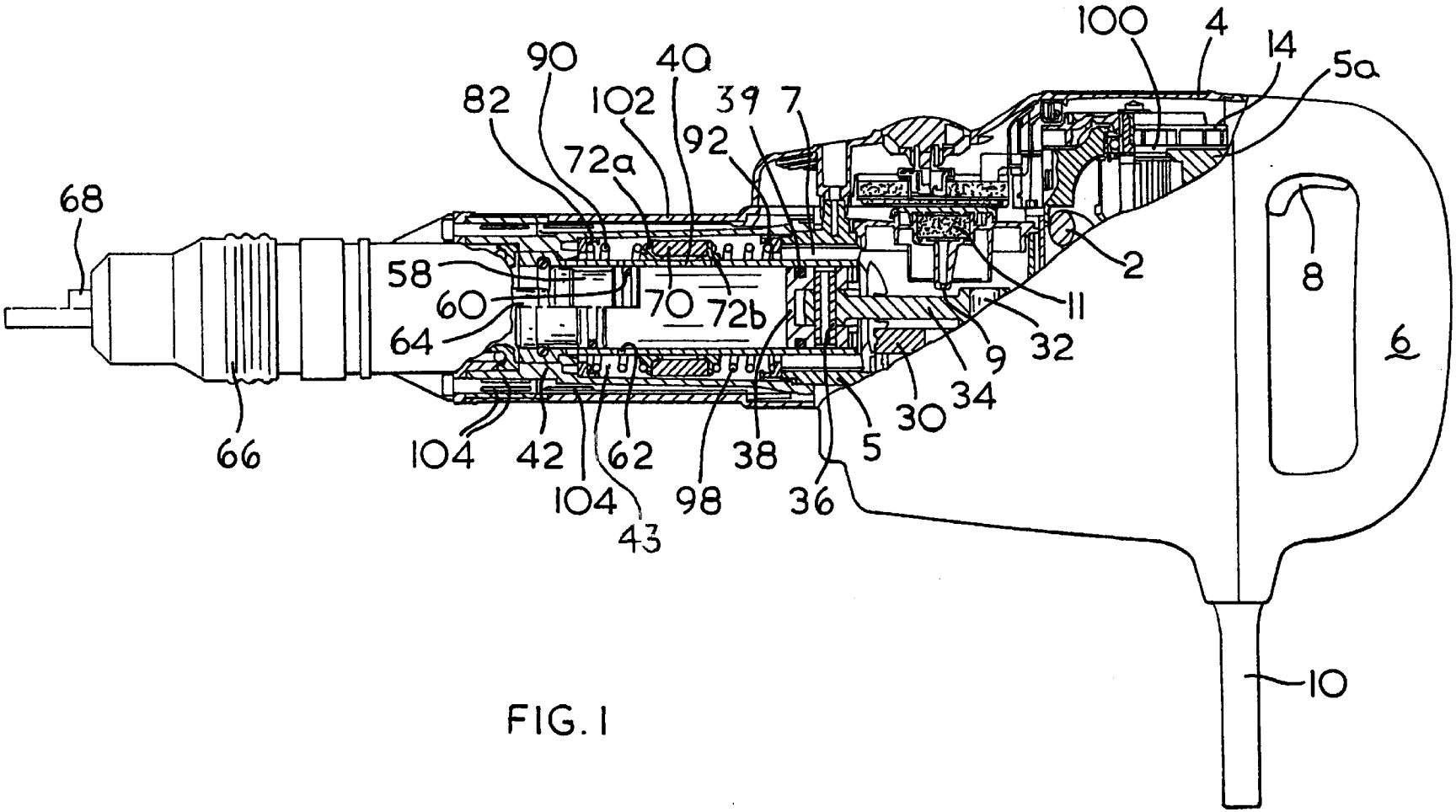
FIG. 1 shows a partially cutaway longitudinal cross section through a demolition hammer incorporating a vibration damping and spindle cooling arrangement according to the present invention.
Figure 2:
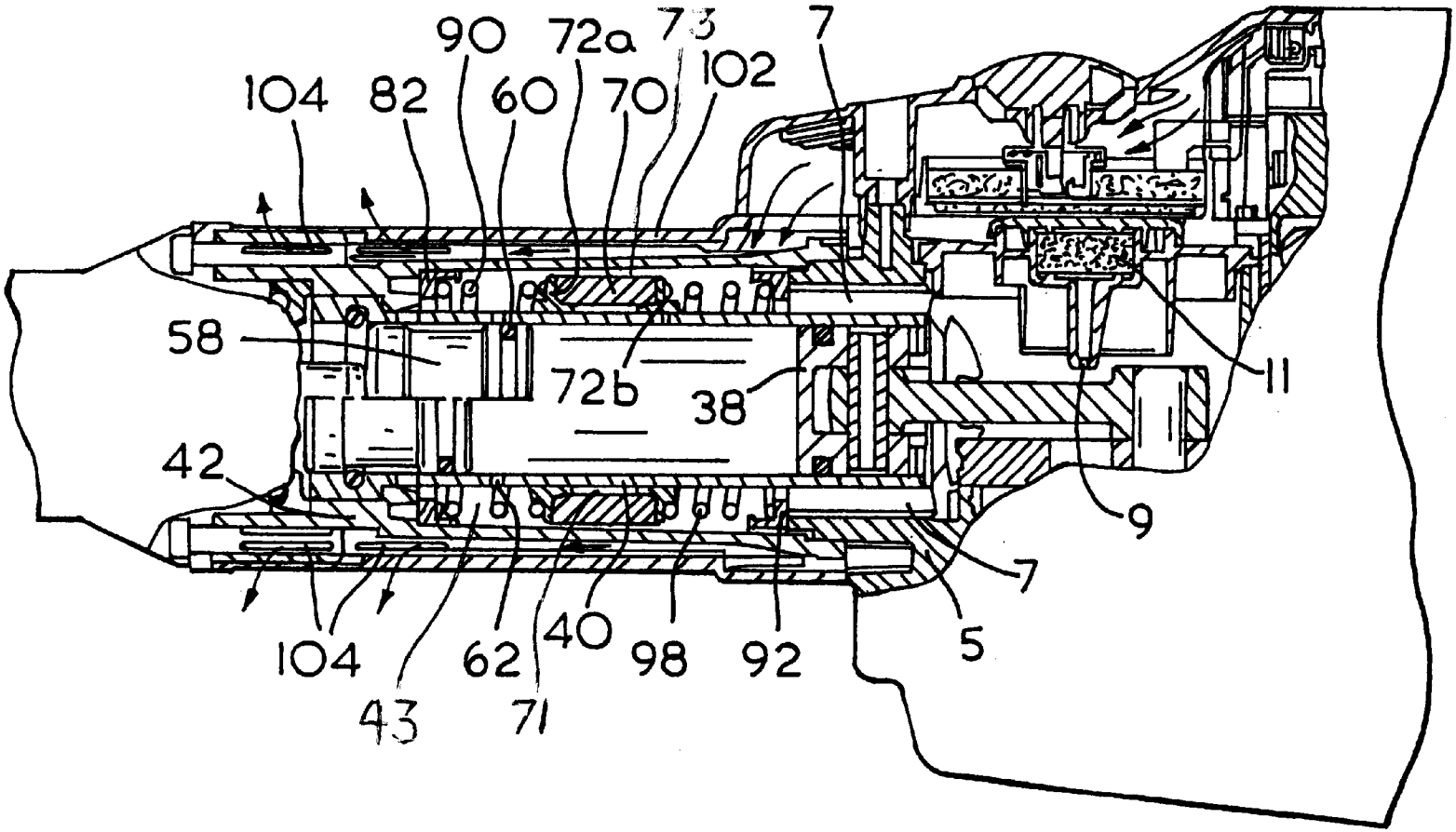
FIG. 2 shows a partially cutaway enlarged longitudinal cross-section of the spindle portion of the demolition hammer shown in FIG. 1.
Figure 4C:
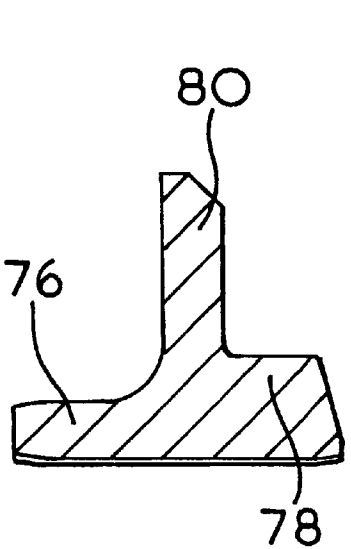
FIG. 4*c* shows a radial cross-section of through a portion of the guide ring of FIG. 4*a;*
Figure 4B:
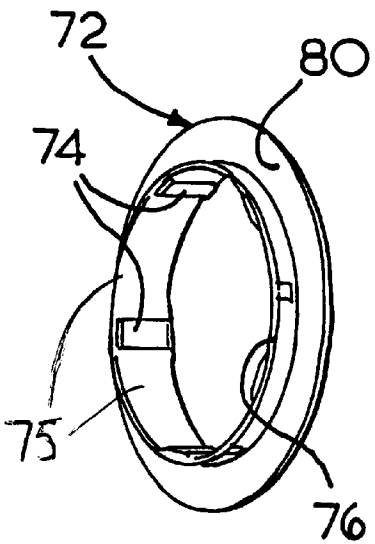
FIG. 4*b* shows a perspective view of the guide ring of FIG. 4*a* from the left hand side of FIG. 4*a;*
Figure 4A:
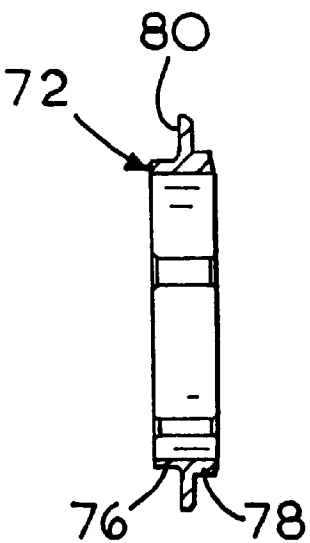
FIG. 4*a* shows a longitudinal cross-section of one of the guide rings for guiding the damping mass shown in FIG. 3.
Figure 3:
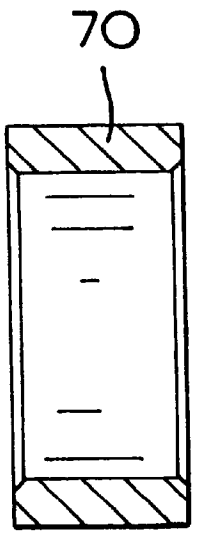
FIG. 3 shows a longitudinal cross-sectional view of the damping mass used in the vibration damping and spindle cooling arrangement of FIGS. 1 and 2.
Figure 5A:
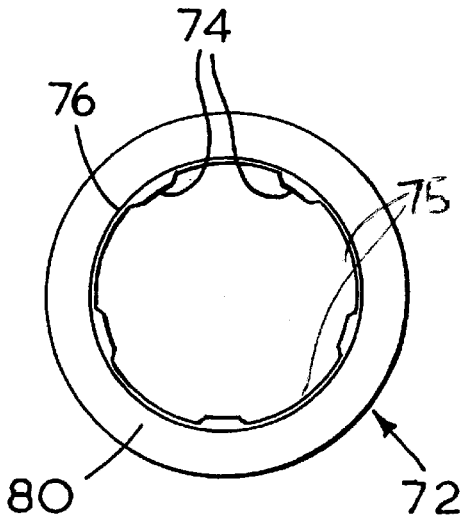
FIG. 5*a* shows a side view of the guide ring of FIG. 4*a* from the left hand side of FIG. 4*a;*
Figure 5B:
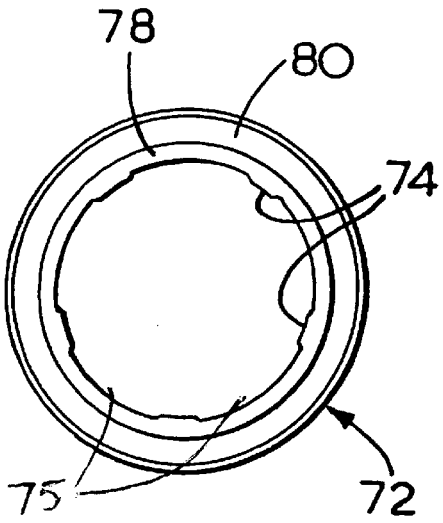
FIG. 5*b* shows a side view of the guide ring of FIG. 4*a* from the right hand side of FIG. 4*a;*

A demolition hammer incorporating a vibration damping and spindle cooling arrangement according to the present invention is shown in FIGS. 1 and 2. The hammer comprises an electric motor (2), a gear arrangement and a piston drive arrangement which are housed within a metal gear casing (5) surrounded by a plastic housing (4). A rear handle housing incorporating a rear handle (6) and a trigger switch arrangement (8) is fitted to the rear of the housings (4, 5). A cable (not shown) extends through a cable guide (10) and connects the motor to an external electricity supply. Thus, when the cable is connected to the electricity supply and the trigger switch arrangement (8) is depressed the motor (2) is actuated to rotationally drive the armature of the motor. A radial fan (14) is fitted at one end of the armature and a pinion is formed at the opposite end of the armature so that when the motor is actuated the armature rotatingly drives the fan (14) and the pinion. The metal gear casing (5) is made from magnesium with steel inserts and rigidly supports the components housed within it.

The motor pinion rotatingly drives a first gear wheel of an intermediate gear arrangement which is rotatably mounted on a spindle, which spindle is mounted in an insert to the gear casing (5). The intermediate gear has a second gear wheel which rotatingly drives a drive gear. The drive gear is non-rotatably mounted on a drive spindle which spindle is rotatably mounted within the gear casing (5). A crank plate (30) is non-rotatably mounted at the end of the drive spindle remote from the drive gear, which crank-plate is formed with an eccentric bore for housing an eccentric crank pin (32). The crank pin (32) extends from the crank plate into a bore at the rearward end of a crank arm (34) 50 that the crank arm (34) can pivot about the crank pin (32). The opposite forward end of the crank arm (34) is formed with a bore through which extends a trunnion pin (36) 50 that the crank arm (34) can pivot about the trunnion pin (36). The trunnion pin (36) is fitted to the rear of a piston (38) by fitting the ends of the trunnion pin (36) into receiving bores formed in a pair of opposing arms which extend to the rear of the piston (38). The piston is reciprocally mounted in a cylindrical hollow spindle (40) 50 that it can reciprocate within the hollow spindle. An O-ring seal (39) is fitted in an annular recess formed in the periphery of the piston (38) 50 as to form an air tight seal between the piston (38) and the internal surface of the hollow spindle (40).

Thus, when the motor (2) is actuated, the armature pinion rotatingly drives the intermediate gear arrangement via the first gear wheel and the second gear wheel of the intermediate gear arrangement rotatingly drives the drive spindle via the drive gear. The drive spindle rotatingly drives the crank plate (30) and the crank arm arrangement comprising the crank pin (32), the crank arm (34) and the trunnion pin (36) convert the rotational drive from the crank plate (30) to a reciprocating drive to the piston (38). In this way the piston (38) is reciprocatingly driven back and forth along the hollow spindle (40) when the motor is actuated by a user depressing the trigger switch (8).

Figure 7A:
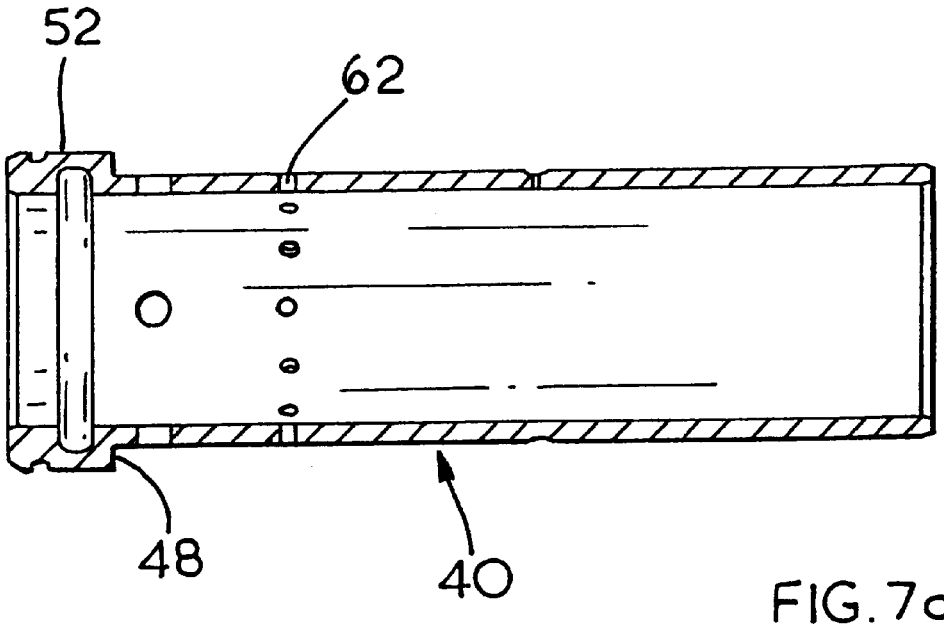
FIG. 7*a* shows a longitudinal cross-section through the spindle of the demolition hammer shown in FIGS. 1 and 2.
Figure 7B:
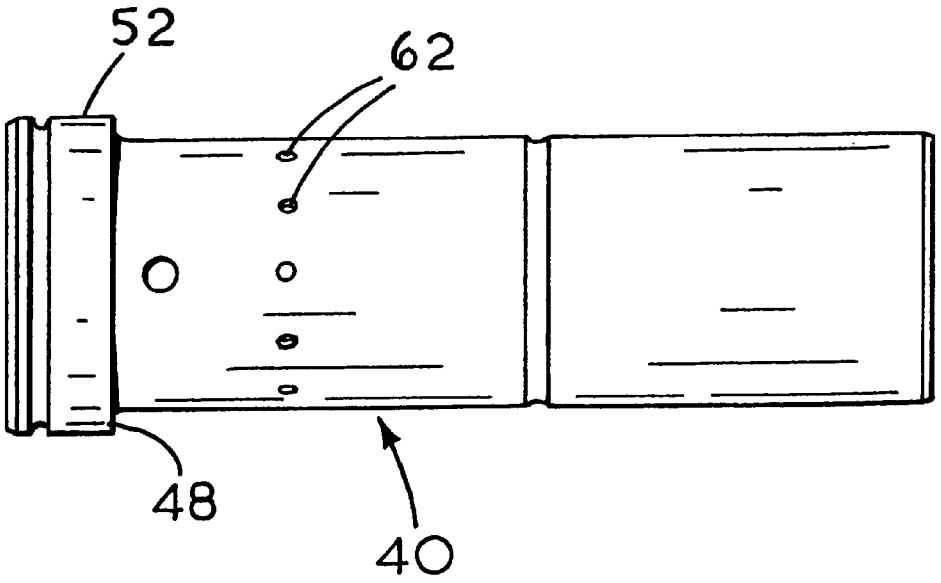
FIG. 7*b* shows a side view of the spindle of the demolition hammer shown in FIGS. 1 and 2.
Figure 8A:
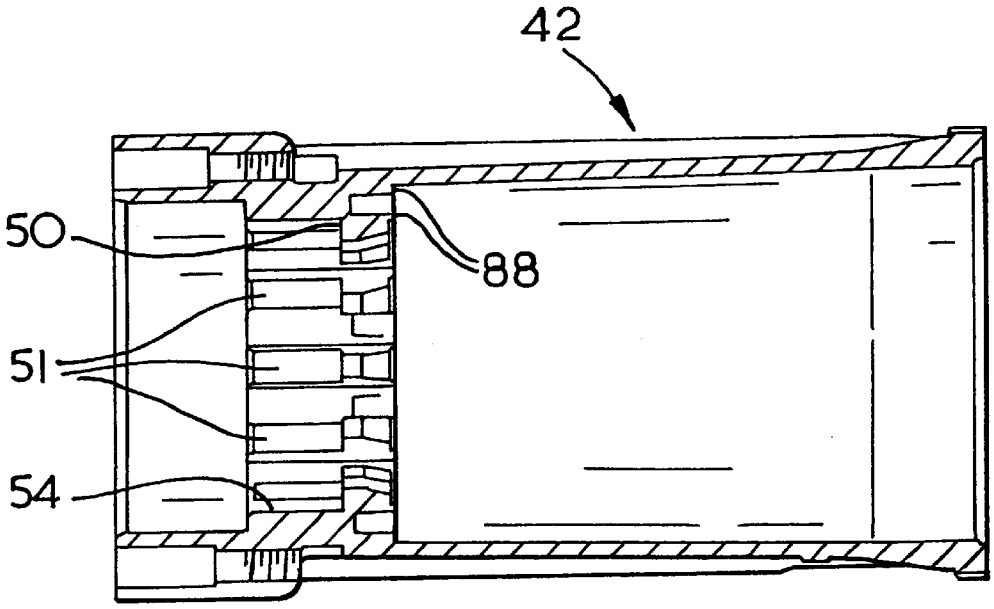
FIG. 8*a* shows a longitudinal cross-section through a magnesium casing part which surrounds the spindle and damping mass arrangement of FIGS. 1 and 2.
Figure 8B:
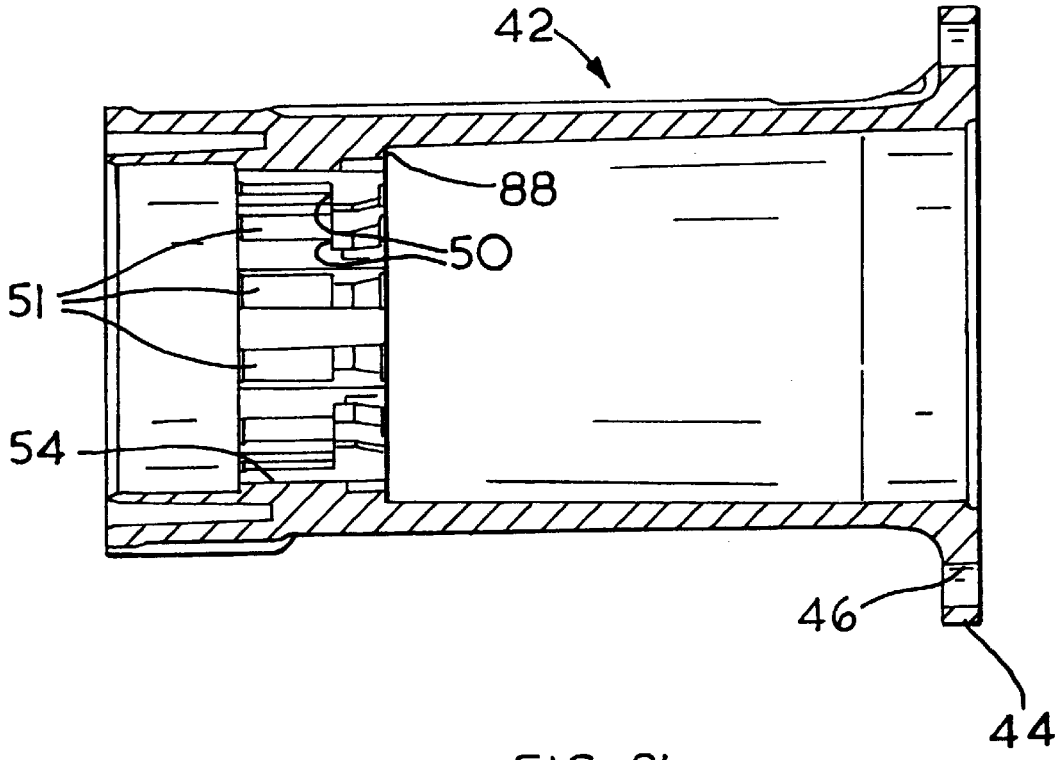
FIG. 8*b* shows a longitudinal cross-section through the magnesium casing of FIG. 8*a* at 45° to the cross-section shown in FIG. 8*a*.
Figure 8C:
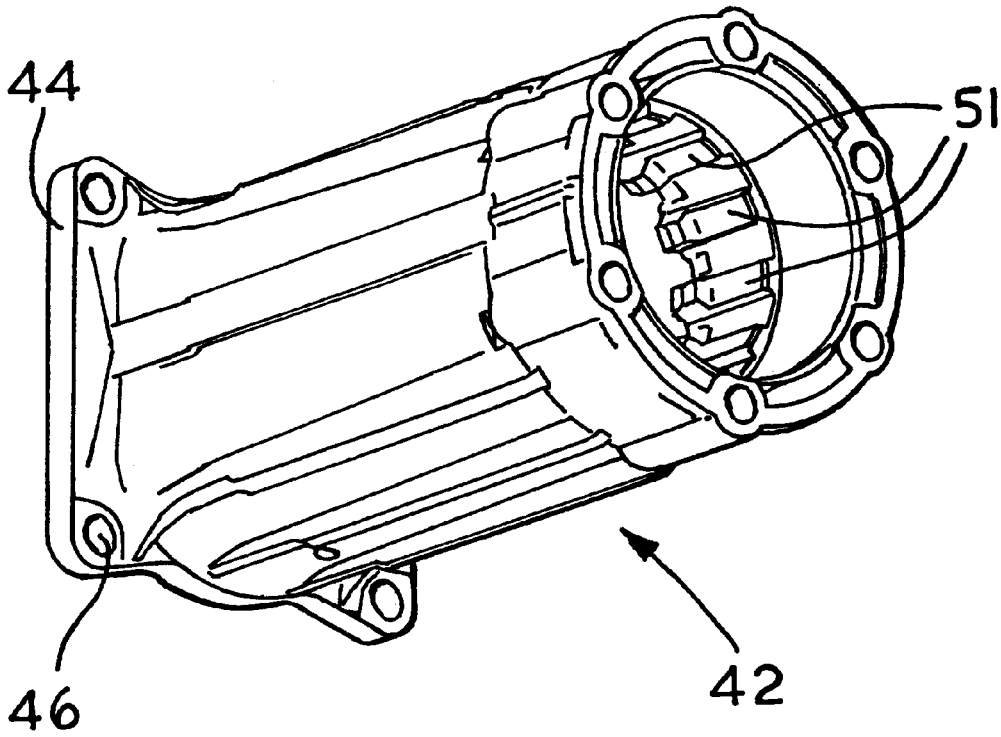
FIG. 8*c* shows a perspective view from the front of the magnesium casing part of FIGS. 8*a* and 8*b*.

The spindle is shown on its own in FIGS. 7*a* and 7*b*. The rearward end of the spindle (40) in which is located the piston (38) is mounted within a circular recess formed in the forward end of the gear casing (5). The circular recess is formed with a plurality of radially inwardly extending ribs (7) which support the rearward end of the spindle while enabling air to freely circulate between the interior of the gear casing (5) and a chamber surrounding the spindle (40). The forward end of the spindle (40) is mounted within a magnesium casing part (42) shown on its own in FIGS. 8*a* to 8*c*. The rearward end of the magnesium casing (42) is formed with two opposing flanges (44) in which are formed four bores (46). The bores (46) are formed so as to be regularly spaced around the periphery of the rear of the magnesium casing (42). The rearward end of the magnesium casing (42) is fitted over and butted up against a circular rim extending from the forward end of the gear casing (5) and is then fitted to the gear casing (5) via four screw bolts (not shown) which pass through the bores (46) and extend into threaded bores in the gear casing (5).

The spindle (40) is mounted in the magnesium housing (42) from the forward end until an annular rearward facing shoulder (48) on the exterior of the spindle buts up against a forward facing annular shoulder (50) formed from in set of ribs (51) in the interior of the magnesium casing (42). The ribs enable air in the chamber surrounding the spindle (40) to circulate freely in the region between the ram (58) and the beatpiece (64). An increased diameter portion (52) on the exterior of the spindle (40) fits closely within a reduced diameter portion (54) on the interior of the magnesium casing (42). Rearwardly of the increased diameter portion (52) and the reduced diameter portion (54) an annular chamber (43) is formed between the external surface of the spindle (40) and the internal surface of the magnesium casing (42) in which the vibration reduction and spindle cooling arrangement according to the present invention is located. This chamber (43) is open at its forward and rearward ends as described above. At its forward end the chamber (43) communicates via the spaces between the ribs (51) in the magnesium casing with a volume of air between the ram (58) and the beatpiece (64). At its rearward end the chamber (43) communicates via the spaces between the ribs (7) in the recess of the gear casing (5) with a volume of air in the gear casing (5).

The volume of air in the gear casing (5) communicates with the air outside of the hammer via a narrow vent (9) and a filter (11). Thus, the air pressure within the hammer, which changes due to changes in the temperature of the hammer, are equalised with the air pressure outside of the hammer. Also, the filter (11) keeps the air within the hammer rear casing (5) relatively clean and dust free.

A ram (58) is located within the hollow spindle (40) forwardly of the piston (38) so that it can also reciprocate within the hollow spindle (40). An O-ring seal (60) is located in a recess formed around the periphery of the ram (58) so as to form an air tight seal between the ram (58) and the spindle (40). In the operating position of the ram (58) (shown in the upper half of FIGS. 1 and 2), with the ram located behind bores (62) in the spindle a closed air cushion is formed between the forward face of the piston (38) and the rearward face of the ram (58). Thus, reciprocation of the piston (38) reciprocatingly drives the ram (58) via the closed air cushion. When the hammer enters idle mode (ie. when the hammer bit is removed from a workpiece), the ram (58) moves forwardly, past the bores (62) to the position shown in the bottom half of FIGS. 1 and 2. This vents the air cushion and so the ram (58) is no longer reciprocatingly driven by the piston (38) in idle mode, as is well known in the art.

A beatpiece (64) is guided so that it can reciprocate within a tool holder body (66) which tool holder body is mounted at the forward end of the magnesium casing (42). A bit or tool (68) can be releasably mounted within the tool holder body (66) so that the bit or tool (68) can reciprocate to a limited extent within the tool holder body (66). When the ram (58) is in its operating mode and is reciprocatingly driven by the piston (38) the ram repeatedly impacts the rearward end of the beatpiece (64) and the beatpiece (64) transmits these impacts to the rearward end of the bit or tool (68) as is known in the art. These impacts are then transmitted by the bit or tool (68) to the material being worked.

When a user of the hammer presses the bit or tool (68) onto a workpiece, the bit or tool (68) is moved rearwardly in the tool holder body (66) to the position shown in the upper half in FIGS. 1 and 2. The bit or tool (68) thus pushes the beatpiece (64) rearwardly which pushes the ram (58) rearwardly to the positions shown in the upper half of FIGS. 1 and 2. This rearward movement of the ram (58) causes the ram to pass rearwardly over the bores (62) in the spindle (40) to close the air cushion between the piston (38) and the ram (58). Thus, when the motor (2) is actuated and the piston reciprocates the ram (58) is reciprocatingly driven to repeatedly impact the beatpiece (64) and thereby impacts are repeatedly transmitted to the workpiece, via the beatpiece (64) and the bit or tool (68).

When a user removes the tool or bit from the workpiece, the next forward reciprocation of the piston (38) drives the ram (58) forwardly. As the ram (58) is no longer pushed rearwardly by the beatpiece (64) it moves forwardly past the bores (62) in the spindle (40) to vent the air cushion and the next rearward movement of the piston (38) does not pull the ram (58) rearwardly. Thus, reciprocation of the ram (58), beatpiece (64) and tool or bit (68) is immediately arrested when the tool or bit (68) is removed from the workpiece.

The vibration damping and spindle cooling arrangement according to the present invention comprises a cylindrical mass (70) which is supported co-axially around the spindle (40) on two spacer elements or guide rings (72*a*, 72*b*), one of which is shown in more details in FIGS. 4*a* to 5*b* so that a small annular gap (71) is formed between the radially inward facing surface of the mass (70) and the radially outward facing surface of the spindle (40). The radially inward facing surface of each guide ring (72) is formed with five of axially aligned ribs (74). The ribs (74) fit slideably over the outer surface of the spindle (40) and provide a relatively low friction mounting for the guide rings (72) on the outer surface of the spindle (40). The spaces between the ribs (74) form channels (75) through which air can flow. Each guide ring (72) has a thin annular portion (76) which extends towards and supports an end of the damping mass (70) and a thicker annular portion (78) which extends away from the damping mass (70). A radially outwardly directed annular portion (80) is formed between the thin annular portion (76) and the thick annular portion (78). Thus, the radially inward facing surface at the front of the damping mass (70) is supported on the radially outwardly facing surface of the thin (rearward facing) annular portion (76) of the front guide ring (72*a*) and the radially inward facing surface at the rear of the damping mass (70) is supported on the radially outwardly facing surface on the thin (forward facing) annular portion (76) of the rear guide ring (72*b*). In this way the damping mass (70) is supported, so that it is able to reciprocate back and forth along the spindle (40) in the annular chamber (43) between the outer surface of the spindle (40) and the inner surface of the magnesium casing (42) with a small radial gap (71) of between 0.5 mm and 2 mm, between the inner surface of the damping mass (70) and the outer surface of the spindle (40), and with a small radial gap (73) of between 0.5 mm and 2 mm, between the outer surface of the damping mass (70) and the inner surface of the magnesium casing (42).

Figure 6A:
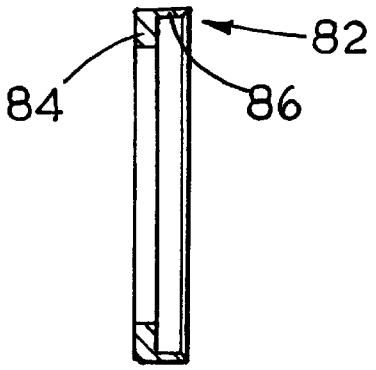
FIG. 6*a* shows a longitudinal cross-section through a forward spring holder for supporting the forward end of a forward spring of the vibration damping and spindle cooling arrangement of FIGS. 1 and 2.
Figure 6B:
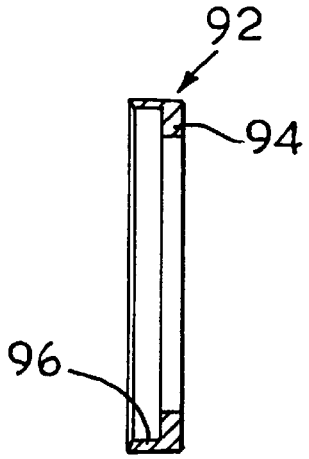
FIG. 6*b* shows a longitudinal cross-section through a rearward spring holder for supporting the rearward end of a rearward spring of the vibration damping and spindle cooling arrangement of FIGS. 1 and 2.

A forward spring guide (82) which is shown in more detail in FIG. 6*a* is formed with an L-shaped radial cross section with an annular radially inwardly extending forward portion (84) and a rearwardly extending annular portion (86). The forward end of the forward spring guide (82) abuts a rearwardly facing internal shoulder (88) formed inside the magnesium casing (42) by the series of ribs (51) which also form the forwardly facing shoulder (50). A forward spring (90) is supported between the forward spring guide (82) and the radially outwardly directed annular portion (80) of the forward ring guide (72*a*). A rearward spring guide (92) which is shown in more detail in FIG. 6*b* is formed with an L-shaped radial cross section with an annular radially inwardly extending rearward portion (94) and a forwardly extending annular portion (96). The rearward end of the rear spring guide abuts a part of the gear casing (5) within which the spindle (40) is mounted. A rearward spring (98) is supported between the rearward spring guide (92) and the rearward ring guide (72*b*).

In this way the damping mass (70) is located between two springs (90, 98) which apply opposing biasing forces to the opposite sides of the mass. Accordingly, in a resting position the damping mass (70) is located at the point where the biasing forces from the two springs (90, 98) balance.

The fan (14) on the end of the armature shaft of the motor (2) is rotatingly driven when the motor (2) is actuated. When it is rotating the fan (14) draws air axially into it from the motor housing (5*a*) through a fan inlet (100) which is formed in the upper part of the motor housing (5*a*). The air pulled into the fan is used for cooling the motor (2). The fan (14) expels air radially outwardly. The air expelled from the fan is used to cool the magnesium casing (42) and is directed through a labyrinth formed by various housing part over the outer surface of the gear casing (5) and over the outer surface of the magnesium casing (42) as shown by the arrows in FIG. 2. An outer housing part (102) is fitted to the front of the plastic housing (4) and extends around the magnesium casing (42) with an annular gap located between the inner surface of the outer housing part (102) and the outer surface of the magnesium casing. The outer housing part (102) is formed with a plurality of air vents (104) through which air can escape. Thus, the air expelled from the fan (14) is directed into this annular gap between the magnesium casing (42) and the outer housing part (102) and exits the outer housing part (102) via the air vents (104). This air that passes over the magnesium housing part (42) cools the magnesium housing part.

The purpose of the damping mass (70) between the springs (90, 98) is to compensate for vibrations of the hammer components so that the resulting vibrations transmitted to the handle of the hammer which have to be withstood by a user are minimised. The damping mass compensates for vibrations caused by the reciprocation of the ram (58) within the spindle (40), the reciprocation of the piston (38) and the parts driving the piston and the reverse impacts from the workpiece which pass through the tool or bit (68) via the beatpiece (64) to the magnesium casing (42). To do this the momentum of the following components have to be taken into account:

momentum of the ram;

momentum of the piston and all masses which are fixed to the piston;

momentum of the housing parts and all masses fixed to the housing parts;

momentum of the reverse impacts from the workpiece (ie. of the beatpiece); and momentum of the hand arm system, including the load applied by the operator when urging the bit or tool against a workpiece.

Taking the above factors into account the mass of the damping mass (70) and the spring constants of the springs (90, 98) are optimised, for example, using computer modelling to achieve a minimum momentum of the housing at the beat frequency of the different reciprocating/vibrating components contained in the housing.

In the arrangement shown in FIG. 1 the vibration damping mass is made of brass and has a mass of just less than the mass of the ram, so that the combined mass of the damping mass (70), the guide rings (72) and the springs (90, 98) is approximately equal to the mass of the ram. The springs are selected and arranged so that the damping mass (70) oscillates with a frequency which matches the beat frequency of the other components of the hammer. When the hammer is operating, the mass (70) reciprocates at the beat frequency of around 34 Hz and 180° out of phase with the beat frequency of the other component parts within the hammer housing in order to minimise the amount of vibration which is transmitted to the hammer housing. In order to do this the mass (70) is mounted around the spindle (40) between two springs (90, 98) which act between the gear casing (5) (via the rear spring ring (92)) and the magnesium casing (42) (via the forward spring ring (82)) which magnesium casing is rigidly fixed to the gear casing (5).

It should be noted that the travel of the damping mass (70), ie. the distance over which it reciprocates, is also a factor and the greater the travel, the smaller the mass of the damping mass (70) needs to be in order to provide the required vibration damping.

In addition, due to the small radial gaps (71 and 73) between the damping mass (70) and the spindle (40) and between the damping mass (70) and the magnesium casing (42), as the damping mass (70) reciprocates in the air filled chamber (43) between the spindle (40) and magnesium casing (42) air turbulence is created. It should be noted that air is free to move between the forward end of the front guide ring (72*a*) and the rearward end of the rearward guide ring (72*b*) through the gap between the mass (70) and the spindle (40) via the channels (75) between the ribs (74) formed on the radially inward facing surfaces of the guide rings (72*a*, 72*b*). As the damping mass (70) moves forwardly increased air pressure is created in front of the mass (70) and reduced air pressure is created to the rear of the mass which causes air in the chamber (43) to move rearwardly past the mass (70). Then as the damping mass (70) moves rearwardly increased air pressure is created to the rear of the mass (70) and reduced air pressure is created forward of the mass which causes air in the chamber (43) to move forwardly past the mass (70). This air turbulence improves the heat transfer from the metal spindle (40) to the air in the chamber (43) and from the air in the chamber to the magnesium casing (42). This heat transfer is further improved due to the airflow over the magnesium casing (42) generated by the fan (14) and described above. This provides greatly improved cooling of the hammer spindle (40).

The oscillating damping mass (70), in the Figures, displaces an air volume equivalent to its cross sectional area of 1359 $mm^2$ multiplied by the stroke length of the mass, which is estimated to be 20 mm. This results in an average (root mean square) speed for the damping mass (70) of 3 m/s. The radial cross-sectional area of the sum of the air gaps (71 and 73) between the mass (70) and the spindle (40) and the mass (70) and the magnesium casing (42) is 770 $mm^2$. The speed of the air in the chamber (43) pumped by the oscillation of the damping mass (70) is assumed equal to 3 m/s multiplied by the ratio of the cross sectional areas of the mass and the gaps, ie. 1359/770 and so is calculated to have an average speed (RMS) of 5.3 m/s. The heat transfer coefficient between air and metallic parts is approximately 6.4 multiplied by speed of air flow, resulting in a heat transfer between the turbulent air within the chamber and the surrounding metal parts of 23.5 $W/K/m^2$. This approximately three times higher than the heat transfer that occurs under non-turbulent, free convection conditions.

Due to the improved cooling of the spindle (40) which improves the cooling of the reciprocating and impacting components within the spindle the lifetime of a hammer according to the present invention is significantly improved. In particular, the seals (42, 60) surrounding the piston (38) and ram (58) respectively are much less prone to wear due to the reduction in operating temperatures they are required to withstand when the present invention is utilised.

What is claimed is:

1. A hand held electrically powered hammer, comprising a housing within which is located:

a motor;

a hollow spindle within which is located for reciprocation therein a piston and a ram;

a hammer drive arrangement which converts the rotary drive of the motor to a reciprocating drive to the piston;

a tool holder body in which a tool may be mounted for reciprocation;

wherein the reciprocation of the piston reciprocatingly drives the ram via an air cushion such that repeated impacts from the ram are transmitted to a tool mounted in the tool holder body, and wherein the hammer additionally comprises:

a casing which encloses at least part of the spindle so as to define a chamber between the spindle and the casing;

a damping mass which is located within the chamber which damping mass is connected to the hammer housing via a spring element so as to oscillate back and forth along the spindle; and at least one spacer element slideably mounted on the spindle for positioning the damping mass between the spindle and the casing so that a first gap is present between the damping mass and the spindle and a second gap is present between the damping mass and the casing.

2. A hammer according to claim 1 wherein the casing encircles the spindle and the damping mass encircles the spindle and is concentric with the spindle.

3. A hammer according to claim 1 wherein the damping mass comprises a single piece cylinder.

4. A hammer according to claim 1 wherein the damping mass is made from one of steel and brass.

5. A hammer according to claim 1 wherein the spring element comprises a first spring located forwardly of the damping mass between the damping mass and one of the a forward part of the housing and the casing, and a second spring located rearwardly of the damping mass between the damping mass and one of a rearward part of the housing and the casing.

6. A hammer according to claim 1 wherein the spring element is a coil spring which encircles the spindle.

7. A hammer according to claim 1 wherein the damping mass and the spring element are arranged so that the damping mass oscillates back and forth along the spindle out of phase with the beat frequency of the piston.

8. A hammer according to claim 1 wherein the damping mass and the spring element are arranged so that the damping mass oscillates back and forth along the spindle approximately 180° out of phase with the beat frequency of the piston.

9. A hammer according to claim 1 wherein the oscillation of the damping mass within the chamber generates an air flow in one of the first gap and the second gap.

10. A hammer according to claim 1 wherein the spacer element is formed integrally with the damping mass.

11. A hammer according to claim 1 wherein the spacer element comprises a guide arrangement and the damping mass is mounted on the guide arrangement and the guide arrangement is shaped to define at least one channel through which air can flow.

12. A hammer according to claim 1 wherein the spacer element comprises a guide ring.

13. A hammer according to claim 1 wherein the damping mass and the casing encircle the spindle and the spacer element comprises a guide ring and the damping mass is mounted on the guide ring and the guide ring includes ribs formed on the radially inward facing surface of the guide ring, and whereby the guide ring and ribs and spindle define at least one channel through which air can flow.

14. A hammer according to claim 1 additionally comprising a fan for generating airflow over the outer surface of the casing.

15. A hammer according to claim 1 additionally comprising a fan arrangement for generating airflow and a labyrinth for directing the airflow over the outer surface of the casing, and wherein the fan generates airflow which passes over the motor, through the fan and then through the labyrinth and over the casing before exhausting from the housing.

16. A hammer according to claim 1 wherein the hammer housing comprises an inner metal housing arrangement in which the motor, hammer drive arrangement and spindle are mounted and an outer plastic housing rigidly fixed to the inner metal housing.

17. A hammer according to claim 16 wherein the casing is fixed to the inner metal housing arrangement.

18. A hammer according to claim 1 wherein the chamber is vented into the hammer housing.

19. A hand held electrically powered hammer, comprising:

a housing;

a motor;

a hollow spindle a piston and a ram located within the spindle for reciprocation therein;

a hammer drive arrangement which reciprocatingly drives the piston;

a tool holder body in which a tool may be mounted for reciprocation;

a casing which encloses at least part of the spindle so as to define a chamber between the spindle and the casing;

a damping mass which is located within the chamber which damping mass is connected to a spring element so as to oscillate back and forth along the spindle; and at least one spacer element slideably mounted on the spindle for positioning the damping mass between the spindle and the casing so that a gap is present between the damping mass and one of the spindle and the casing.

* * * * *